US005619856A

United States Patent [19]

Lee

[11] Patent Number: 5,619,856

[45] Date of Patent: Apr. 15, 1997

[54] APPARATUS FOR DISPENSING COOLED AND HEATED LIQUIDS

[76] Inventor: Yong N. Lee, 1010 W. Lonnquist Blvd., Mt. Prospect, Ill. 60056

[21] Appl. No.: 406,838

[22] Filed: Mar. 20, 1995

[51] Int. Cl.[6] ..... F25B 21/02; B67D 5/62

[52] U.S. Cl. ..... 62/3.64; 62/390; 62/397; 222/146.6

[58] Field of Search ..... 62/3.2, 3.7, 3.64, 62/6, 389, 390, 391, 393, 394, 396, 397; 165/DIG. 342, DIG. 351, DIG. 358; 222/146.1, 146.6

[56] References Cited

U.S. PATENT DOCUMENTS

| | | | |
|---|---|---|---|
| 964,734 | 7/1910 | Ammons | 62/393 |
| 3,196,634 | 7/1965 | Rich | 62/394 |
| 3,248,011 | 4/1966 | Brodsky et al. | 222/146.1 |
| 3,250,433 | 5/1966 | Christine et al. | 222/146.1 |
| 4,320,626 | 3/1982 | Donnelly | 62/394 |
| 4,793,514 | 12/1988 | Sheets | 222/67 |
| 5,172,832 | 12/1992 | Rodriquez et al. | 222/146.1 |

*Primary Examiner*—William Doerrler
*Attorney, Agent, or Firm*—Robert A. Brown

[57] ABSTRACT

An improved apparatus for dispensing cooled, heated or ambient temperature liquids from a liquid tank which contains therein a cold sink member for maintaining the liquid at a preselected temperature. The cold sink member may be formed in the shape of a cup-like finned member or a tree-like shaped member having outwardly extending fingers in order to greatly increase the transfer of heat energy within the liquid tank and to reduce the thickness of boundary layer formation in the cold sink member. The apparatus includes adapter means operable to supply separately controlled, selective dispensing of any of the chilled, heated, or ambient temperature liquids.

24 Claims, 10 Drawing Sheets

APPARATUS FOR DISPENSING COOLED AND HEATED LIQUIDS

BACKGROUND OF THE INVENTION

The present invention relates generally to an apparatus for dispensing cooled, heated and ambient temperature liquids such as drinking water and other beverages, and more particularly to an energy transfer device for use in a dispenser apparatus wherein liquid is drawn from a filled reservoir bottle or the liquid is supplied directly from a source of high pressure, such as tap water.

DESCRIPTION OF THE PRIOR ART

A bottled liquid dispensing unit equipped with a refrigerating system to cool liquids and/or a heating device to heat liquid is becoming a popular appliance. The oldest means of cooling liquid is a vapor compression, Rankine cycle refrigeration using CFC refrigerants. Due to environmental problems with the CFC refrigerants, however, recent trends are to use other means of refrigeration. There are two non-Rankine cycle, non-CFC methods of refrigeration: thermoelectric and free-piston Stirling cooling technologies. The thermoelectric cooling means, which is a solid-state device, precludes any potential environmental problems. The free-piston Stirling cooling technology uses inert gas as refrigerant and does not harm the environment.

Prior inventions using the thermoelectric principle, which are relevant to the present one are found in U.S. Pat. No. 3,088,289 of Alex, U.S. Pat. No. 3,250,433 of Christine, U.S. Pat. No. 3,270,513 of Ter Bush, U.S. Pat. No. 3,327,485 of Ter Bush, U.S. Pat. No. 4,993,229 of Baus, U.S. Pat. No. 4,996,847 of Zickler, and U.S. Pat. No. 5,072,590 of Burrows. All of these have some common features in addition to the fact that they all have a thermoelectric subassembly. One feature is that the liquid bottle is inverted on top of the water tank wherein liquid is chilled. The second is that the thermoelectric subassembly has a thick metal block between the water tank and thermoelectric module. The metal block is to increase the distance between the thermoelectric module and the liquid tank, which is required to reduce the heat leakage from the hot-side of the module to the liquid tank. The metal block, however, causes to have one extra interface between the block and the liquid tank. One of the most serious problems to effective heat transfer in thermoelectric devices is the thermal resistance created by the interfaces.

The Ter Bush patents U.S. Pat. No. 3,270,513 and 3,327,485 and the Alex patent U.S. Pat. No. 3,088,289 use a metallic band to join mechanically between a cylindrical liquid tank and the thermoelectric subassembly.

The Christine patent U.S. Pat. No. 3,250,433 uses a rectangular water tank and uses bolts and nuts to join between the water tank and the thermoelectric subassembly.

In all patents except U.S. Pat. No. 3,250,433 of Christine and U.S. Pat. No. 4,996,847 of Zickler, the inverted liquid bottle mouth directly connects with the widely open liquid surface of the liquid tank. As will be seen, this arrangement is detrimental to cooling of liquid in the liquid tank due to convective heat exchange of chilled and warm liquids between the liquid tank and the bottle; it also presents a problem of spilling liquid when installing a new bottle filled with liquid into the liquid cooler due to the large mouth size of the bottle. The Christine patent of U.S. Pat. No. 3,250,433 intends to eliminate the problem of the spilling, but it requires a complex, thus expensive adapter. The present invention prevents the convective heat exchange of liquids between the liquid tank and the bottle by using a simple and inexpensive adapter without changing any configuration of the liquid tank. The Zickler patent of U.S. Pat. No. 4,996,847 also uses an adapter to the liquid bottle mouth; in addition it uses a continuous conduit between the liquid bottle and the special liquid cooling honeycomb structure. Since the Zickler patent uses, however, a continuous sealed conduit in addition to the adapter, there will be a substantial amount of inconvenience upon installation and removal of the liquid bottle from the dispenser. The present invention has no conduit to concern about this problem. Further, the Zickler patent is useful only when cooling corrosion-free liquids such as distilled water, if the liquid tank is made of aluminum. Although the honeycomb structure increases surface area of cooling, it is not possible to coat the surface with metal or other materials to prevent corrosion.

In the commercial market, there is a thermoelectric liquid cooler that has a solid bar-like cold sink submerged in liquid. However, the desired performance cannot be obtained due to many drawbacks, such as insufficient surface action, a low heat transfer coefficient and premature ice formation on the cold sink. To date, there is no known liquid cooler in the marketplace built on the principle of Stirling cooling technology.

SUMMARY OF THE INVENTION

Accordingly, it is a primary object of the present invention to provide an improved liquid cooling apparatus that increases the rate of energy transfer in a liquid medium, whether it is a thermoelectric or free-piston Stirling, or any other types of heat pump cooling apparatus.

An object of the present invention is to provide an improved liquid cooling apparatus wherein liquids are cooled by a new configuration of a cold sink that is submerged in liquid.

An additional object of the present invention is to provide an improved liquid cooling apparatus wherein liquids are cooled by a cold sink device having one integral part encompassing a cold sink and spacer.

Another object of the present invention is to provide an improved liquid cooling apparatus that reduces heat leakage between a surrounding environment and chilled liquid in a dispenser by use of an adapter to a liquid bottle disposed in the dispenser, thus preventing rewarming of liquid.

A further object of the present invention is to provide an improved liquid cooling apparatus wherein liquid is cooled uniformly throughout the entire volume of liquid contained in a bottle dispenser.

Yet another object of the present invention is to provide an improved liquid cooling apparatus wherein a layer of ice is formed on a cold sink surface so as to thinly deposit the layer of ice formed on the cold sink surface so as to make the thickness of the ice layer thin and yet increase the total amount of ice formed on the surface of the cold sink.

A still further object of the present invention is to provide an improved liquid cooling apparatus wherein a fan and heat sink are arranged for improved system efficiency and achieve a lower cost effectiveness in the manufacture thereof.

A latter object of the present invention is to provide an improved liquid cooling apparatus wherein liquid is heated separately means for dispensing hot liquid from the apparatus and additionally, there is provided separate means for cooling the liquid.

An improved thermoelectric liquid cooler apparatus constructed in accordance with the present invention comprises the following basic components: a liquid tank, liquid heating means, cold sink means, a heat pump or thermoelectric sub-assembly, a liquid bottle with an adapter, and accessories. The cold liquid tank is made of an insulating material. The cold sink, which may be a part of the thermoelectric sub-assembly, is submerged in liquid of the cold liquid tank. The heat pump may include a cold plate or head and some form of heat dissipating means, such as a heat sink. The entire surface of the cold sink, made of thermally conductive metal such as aluminum, extruded or cast, is treated, or coated with a metal or other materials to protect the submerged metal surface from corrosion due to contact with liquid.

In the following description of the present invention, thermoelectric means is employed as a heat pumping system as a matter of convenience. However, it will be understood that the use of a free piston Stirling heat pump system in lieu of the aforesaid thermoelectric means may be accomplished without detracting from the essence of the present invention.

Accordingly, an improved liquid cooling/heating apparatus includes a liquid tank, a source of liquid for supplying liquid to the liquid tank, and a cold sink member affixed to the liquid tank and submerged in the liquid for controlling the temperature therein, said cold sink member comprising upwardly extending, circular, thick wall means constructed from thermally conducting material, thermally conductive, thick bottom wall means integrally joined at a lower side of said circular, thick wall means effective to form therebetween cup-like structure means, said thick wall means has formed therethrough at least two apertures for natural convection flow of liquid between the liquid surrounding an outer surface of said thick walls means and the space within said cup means, heat pump or thermoelectric means disposed adjacent a bottom side of said bottom wall means for exchange of thermal energy therebetween, and heat sink member means positioned adjacent said thermoelectric means for absorbing and dissipating said thermal energy to ambient air.

The present invention requires designs or structure calling not only for an improved cooling rate but also for a minimum amount of temperature difference in liquid to be chilled in the tank. This suggests that liquid in the vicinity of the cold sink is at a higher temperature than that of the conventional liquid coolers, signaling that heat transfer rate from liquid to the cold sink is greater. In all prior inventions, there is a large temperature difference between liquid near the cold sink of the thermoelectric or heat pump cooling sub-assembly and liquid far away from the cold sink of the sub-assembly. The large temperature difference creates the formation of ice over the surface of the cold sink. Since ice is a thermal insulator, it resists to heat transfer from the liquid to the cold sink. Thus, the new inventive concept is to minimize the ice formation, in vast contrast to the popular notion that the ice formation will help cool liquid. A uniform liquid temperature is also an important critical consideration, especially in public health applications, such as cooling of blood. The liquid bottle is equipped with a simple adapter, which will help prevent an absorption of an extraneous ambient thermal temperature increase from the environment and also reduce the chance of spilling liquid during installation of the heavy, liquid-filled bottle into the dispenser.

BRIEF DESCRIPTION OF THE DRAWING

The foregoing and other characteristics, objects, features and advantages of the present invention will become more apparent upon consideration of the following detailed description, having reference to the accompanying figures of the drawing, wherein.

DESCRIPTION OF A PREFERRED EMBODIMENT

Figure 1:
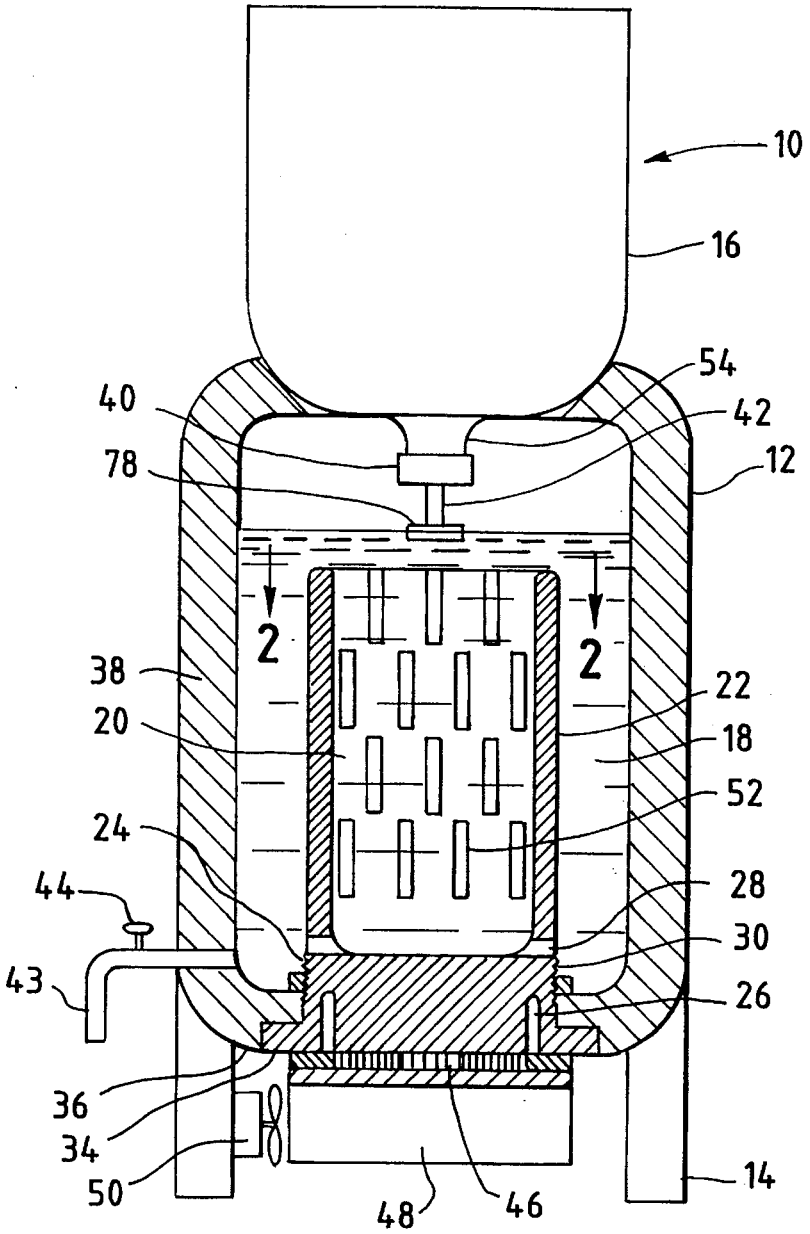
FIG. 1 is a cross-sectional front elevational view of a bottle liquid cooler including a nozzle for dispensing cold liquid and equipped with a cup-like cold sink and an adapter for the liquid bottle of the present invention.

Referring now to FIG. 1, there is shown an improved liquid cooling apparatus, generally indicated by reference numeral 10, including a liquid tank 12 supported on legs 14 and having disposed thereon a reservoir bottle 16. The liquid tank 12 is equipped therein with an inventive cold sink member, generally identified by reference numeral 18, shaped in the form of a cup 20. The cup-like cold sink member 18 is constructed in an integral manner and made of thermally conducting material having an upwardly extending, circular, or other suitably shaped, thick wall 22 which forms therewithin the cup-like structure 20 of the cold sink member 18. A thick wall is needed for providing a large cross-sectional area for heat transfer along the inside and outside circumferential surfaces of the circular wall 22. The cold sink member 18 has a thick bottom wall 24 ranging from 0.5" to 1" or more in thickness. There is formed in the cold sink member 18 an annular, or other suitably shaped configuration, cavity 26 having an open end disposed downwardly at the lower side of the bottom wall 24 of the member 18. The cavity 26 serves to minimize extraneous heat transfer from the surrounding, ambient air by reducing the heat transfer area. The upwardly extending, circular wall 22 has formed therethrough at least two holes or apertures 28 through which liquid inside and outside of the cup 20 may be mixed as a result of natural convection flow. A threaded portion 30 is disposed at an upper side of the bottom wall 24 and in cooperation with a tightening cap screw 32, is effective to join a collar 34 of the cold sink member 18 to a bottom wall 36 of the liquid tank 12. The liquid tank 12 has formed thereabout an upwardly extending thick wall 38, and is made from a thermally insulating material having a high coefficient of heat transfer resistance and has affixed thereto the legs 14 that support the entire liquid cooling apparatus 10.

The reservoir bottle 16 is fitted at its open constricted end with an adapter member 40 having diverter means 42 to facilitate and equalize the circulation and mixing of liquid from the bottle 16 throughout the tank 12 and thereby avoid any direct jet-like flow of liquid into the cup-like structure 20. This arrangement permits a consumer using the apparatus of the present invention to draw off liquid at a constant preselected temperature. It will be understood that the adapter member 40, in addition to the diverter 42, may be fitted with a first outlet for supplying ambient liquid to a separate dispensing nozzle. Further, the adapter 40 may include a second outlet leading to a heating element for heating liquid therein and subsequent supply thereof to a separate dispensing nozzle. (See FIG. 14).

Figure 2:
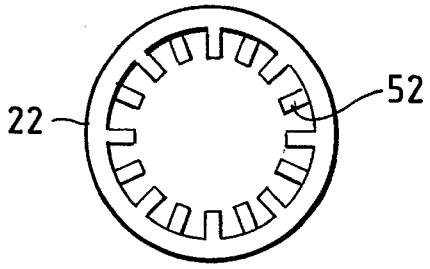
FIG. 2 is a top plan view taken along the line 2—2 of FIG. 1 wherein is shown a cold sink with internal ribs.

In the structure of FIG. 1, the chilled liquid is dispensed through a dispensing nozzle 43. A valve 44 is provided for controlling the flow of liquid from the liquid tank 12 or shutting it off completely. During installation of the liquid bottle 16 that is full of liquid and equipped with the adapter member 40 and diverter 42, the liquid bottle is inverted and the liquid fills the liquid tank 12 until the liquid reaches a level where the diverter 42 of the adapter 40 is positioned, and equilibrium is achieved as the liquid stops flowing down. The apparatus 10 further includes heat pump thermoelectric modules 46 positioned between a heat sink member 48 and the bottom end 24 of the cold sink member 18 and joined theretogether by means of screws or other suitable means. A fan-motor system 50 disposed adjacent the heat sink member 48, supplies air flow to the heat sink member 48. The cup-like cold sink member 18 may include a plurality of short length fins 52 protruding inwardly from its internal peripheral surface as best shown in FIG. 2. The internal fins increase the total heat transfer surface area of the cold sink and hence increase the cooling rate. As will be hereinafter shown, however, the number of fins cannot increase indefinitely, because of space constraints, and the fins must be short in length and off-set from each other in order to accomplish a high rate of heat transfer. The cup wall 22 is rather thick ranging from 1/16" to 1/4" or thicker to provide sufficient cross-sectional area for heat transfer through the wall. As described, the diverter 42 of the adapter 40 controls the liquid level in the liquid tank 12. The adapter 40 may be made of elastic material or other suitable means so that it may be stretched to fit over a mouth 54 of the liquid bottle 16. In FIG. 1, the cold sink 18 may be turned 90 degrees to a horizontal position with all corresponding parts functioning the same. The cup-like cold sink member 18 may also have fins disposed on the external peripheral surface of the cup wall 20, or may be completely devoid of fins on either the internal or external surface thereof.

Figure 3:
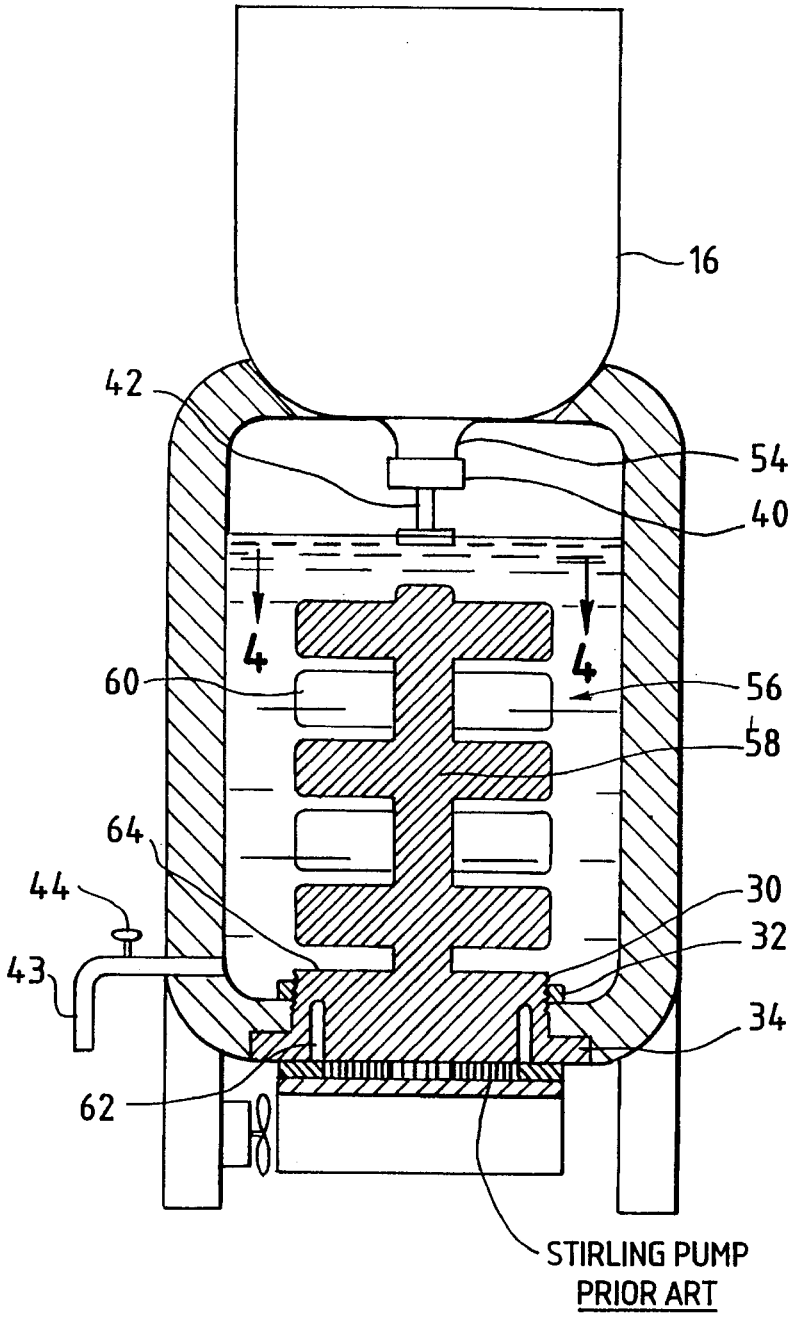
FIG. 3 is a front elevational, sectional view, similar to FIG. 1 except that there is shown another inventive embodiment in the shape of a tree-like cold sink having outwardly extending fingers or fins.
Figure 4:
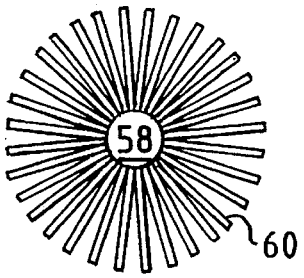
FIG. 4 is a top plan view taken along the line 4—4 of FIG. 3 wherein there is shown the outwardly extending fins of the tree-like cold sink.
Figure 17:
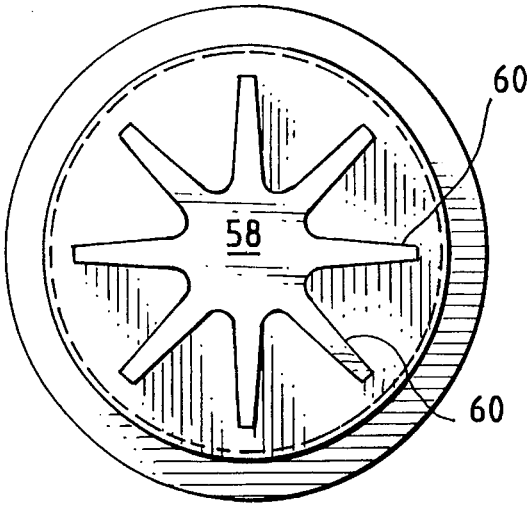
FIG. 17 is a top plan view of the tree-like cold sink shown in FIG. 16 taken along the line 17—17 thereof, depicting the long fins formed in a multi-fingered star-shaped configuration.

Another embodiment of a liquid cooler apparatus of the present invention is shown in FIGS. 3 and 4 wherein is shown a tree-like cold sink member, generally identified by reference numeral 56, and the adapter 40 having a diverter 42 for supplying liquid to the tank 12. The tree-like cold sink member 56 is an integral part made of thermally conducting material having a trunk 58 formed from any suitable round, rectangular, or other configuration, and outwardly extending branches 60. Each branch may have a thickness ranging from 1/16" to 1/4 or thicker. The bottom of the tree-like cold sink member 56 is identical to the cup-like cold sink member 18 in structure and has an annular ring cavity 62 that surrounds the central, thick portion of a bottom wall 64 of the tree-like member 56. The thickness of the bottom wall 64 ranges from 0.5" to 1" or thicker. The annular cavity 62 surrounds the central portion of the bottom wall 64 and serves to minimize the extraneous heat transfer coming from ambient air surrounding the liquid cooling apparatus. The threaded portion 30 is adaptable with the collar 34 to join the entire tree-like cold sink member 56 with the liquid tank 12 by a tightening cap screw or other suitable means. In FIG. 4 there is shown a configuration of star-shaped branches (See FIG. 17) or fingers 60 extending outwardly from the trunk or center rod 58. The tree-like cold sink member 56, similar to cold sink member 18 may be turned 90 degrees to a horizontal position with all corresponding parts functioning the same.

Figure 5:
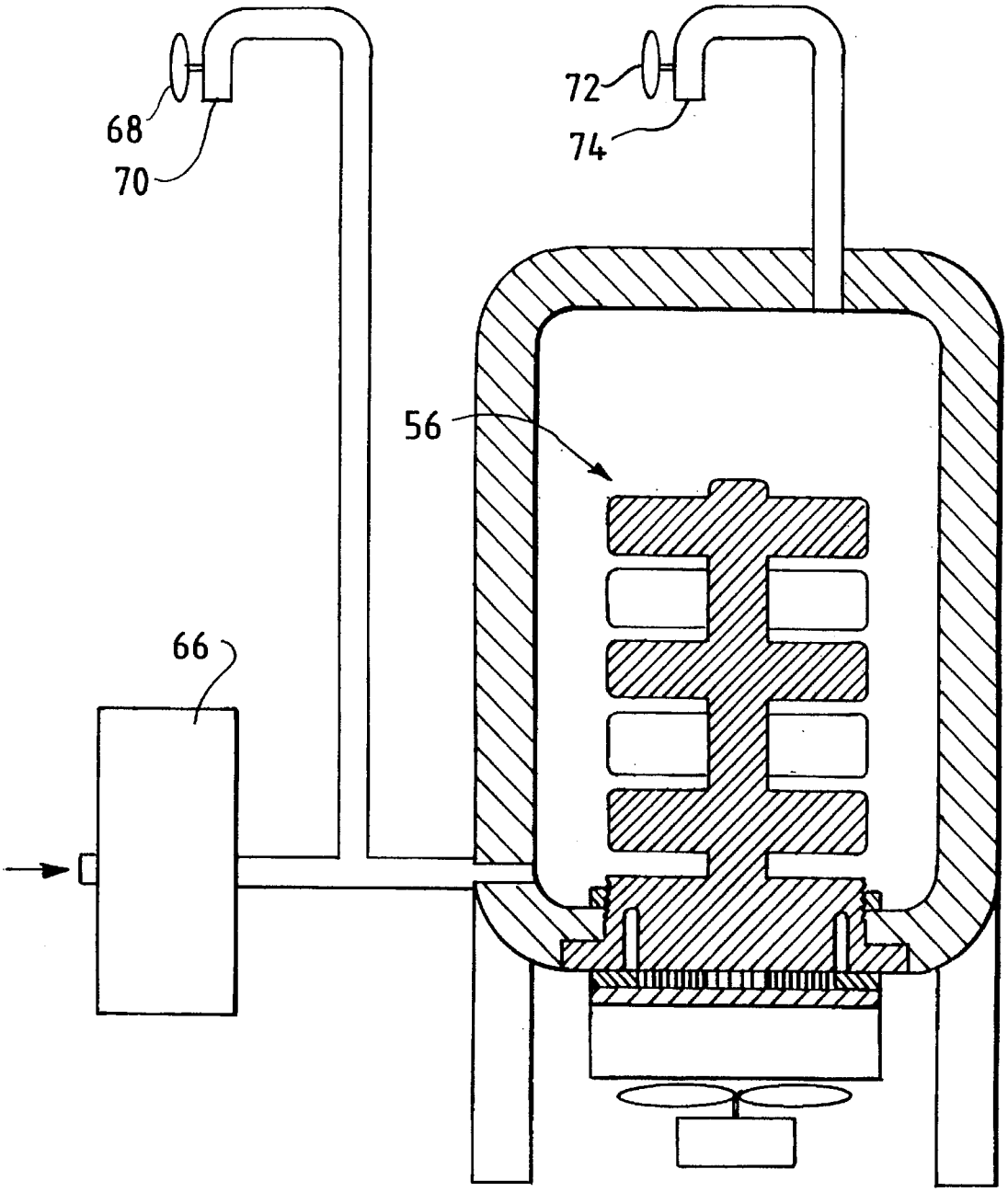
FIG. 5 a cross-sectional view of the liquid cooler wherein the liquid supply line is under pressure.

Yet another preferred embodiment of the present invention is illustrated in FIG. 5. In this case, liquid is supplied from a high pressure source such as tap water. For cooling of drinking water, a water purifying equipment device 66 is normally provided. When water for cooking is required, a valve 68 is used to control the supply of water through an outlet 70. When chilled drinking water is required, a valve 72 is used to supply chilled water supply through outlet nozzle 74. The tree-like cold sink member 56, shown in FIG. 5 is identical to that depicted in FIG. 3. Although a tree-like cold sink member 56 is shown for illustration in FIGS. 3, 4 and 5, it will be understood that a cup-like cold sink member may also be used, and each member may be oriented in a vertical or horizontal position.

Figure 6:
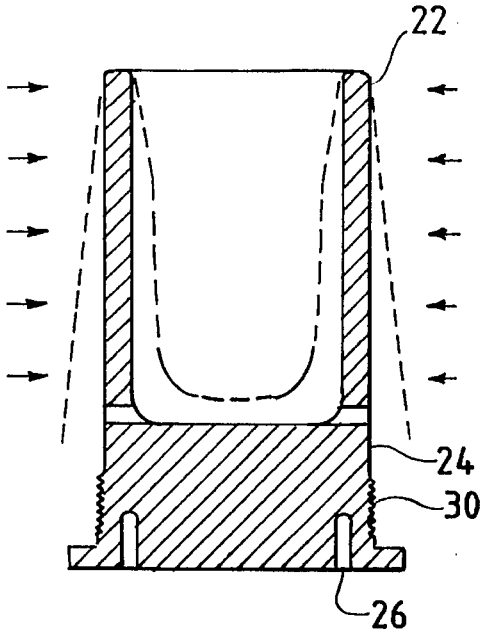
FIG. 6 is a cross sectional, elevational view showing a first structural variation of the cup-like cold sink and the manner in which energy is transferred thereby.
Figure 7:
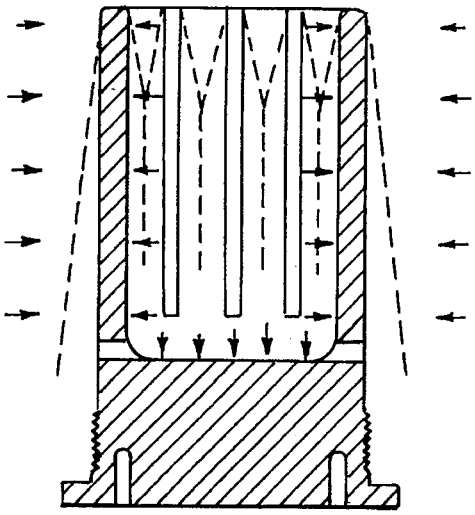
FIG. 7 is a cross sectional, elevational view showing a second structural variation of the cup-like cold sink and the manner in which energy is transferred thereby.

It is now useful to discuss the theoretical background of the present invention. In this connection, the cup-like cold sink structure of FIG. 8 will be used for the purpose of illustration. However, other variations such as those shown in FIGS. 6 and 7 may be utilized. FIG. 6 is the simplest structure having no fins on either the internal or the external surfaces of the cup. FIG. 7 illustrates a cup-like cold sink with internal, long fins. This construction, because of an increased surface area of the cold sink, can generally absorb more heat from the liquid and is superior to that of FIG. 6. As hereinafter explained, when fin density becomes tight, an adverse effect can occur.

Figure 8:
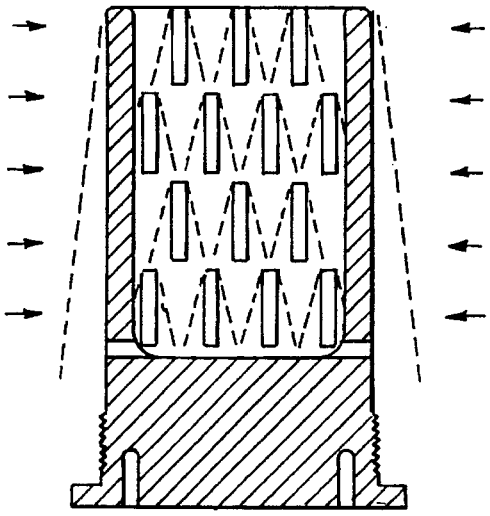
FIG. 8 is a cross sectional, elevational view showing a third structural variation of the cup-like cold sink and the manner in which energy is transferred thereby.

In FIGS. 6, 7 and 8, dotted lines illustrate natural convection boundary layers that have been generated by a density difference between liquid in contact with the cold sink surface and the bulk liquid. Since the liquid in contact with the cold sink is colder than the bulk liquid, the liquid in close proximity is heavier than the bulk liquid, which makes the colder liquid at the cold sink surface move downwardly due to gravity, forming a natural convection boundary layer along the cold sink surface.

FIG. 7 illustrates two boundary layers, as represented by dotted lines, being formed in a channel created between two long fins, the two boundary layers being merged at some distance from the leading edge of the channel. Since the boundary layer hinders heat transfer and since the thicker the boundary layer is, a lesser transfer of heat occurs, it is desirable to keep the average boundary layer thickness as thin as possible. FIG. 8 illustrates why a cold sink having short, off-set fins provides, on the average, a thinner boundary layer and is therefore superior in performance to that of FIG. 7 having long fins. There is another reason why the cold sink of FIG. 8 having short, off-set fins is superior to that of FIG. 7. After the two boundary layers have merged as shown in FIG. 7, the bulk liquid begins flowing downwardly. When the frictional force at the channel surface working upwards is in balance with the downward gravitational force, the bulk flow will stop. This phenomenon is described as a "choking condition" and must be avoided. Once the choking condition exists, the advantage of increased surface area may be offset by the adverse effect of the choking condition. Thus, if sufficiently short, off-set fins are used, boundary layers will not merge, so that it is possible to increase the surface area to its maximum and reduce the boundary layer thickness to increase the cooling effect and yet avoid the choking condition. Notwithstanding the superiority of the above theory of performance, however, a choice among the three inventive configurations of cup-like heat sinks is sometimes based upon the consequences of economic considerations. In this connection, the cold sink structure of FIG. 6 is the least expensive to make.

Figure 9:
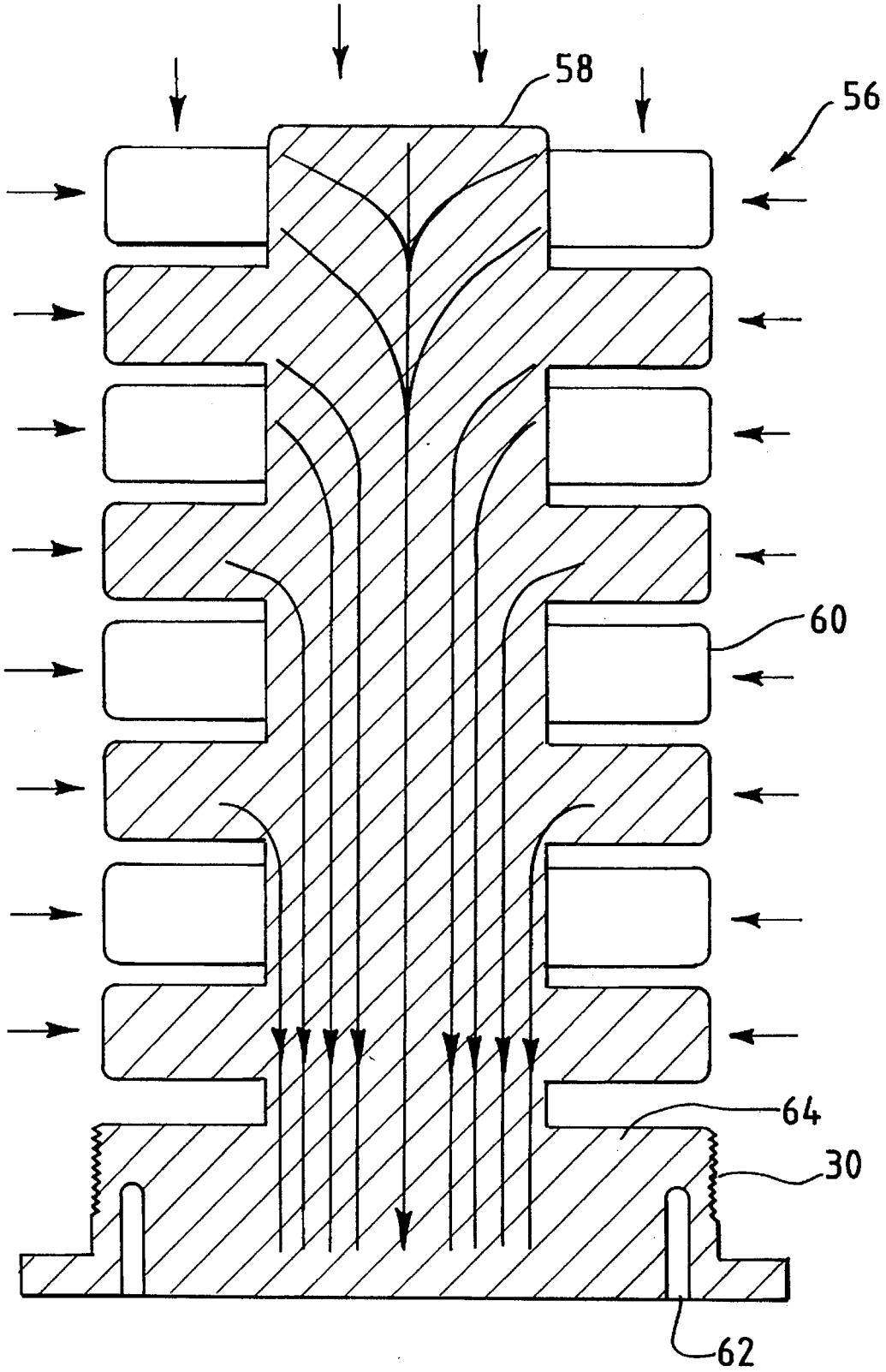
FIG. 9 is a cross sectional, elevational view showing a structural variation of the tree-like cold sink and wherein the direction of energy transfer is indicated by arrows.
Figure 11:
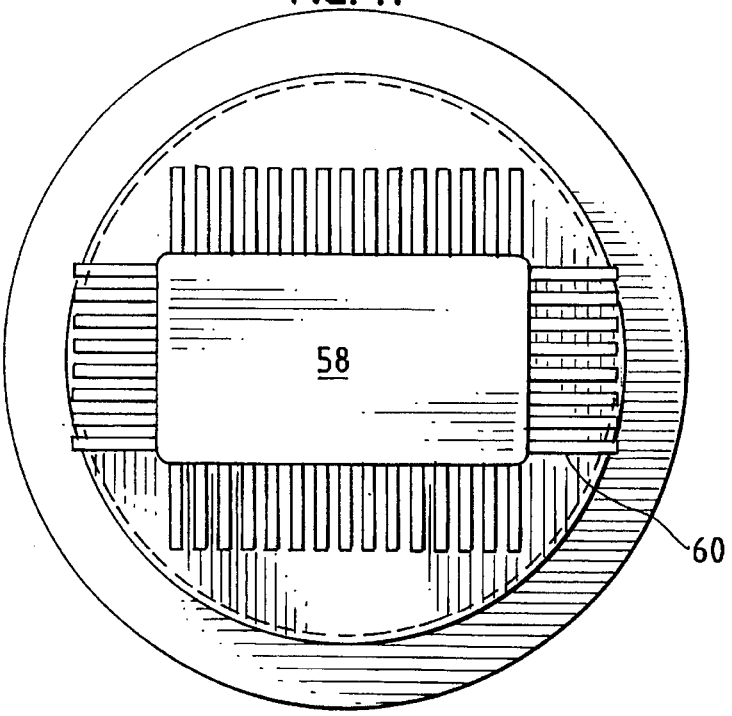
FIG. 11 is a top plan view of the tree-like cold sink shown in FIG. 10 taken along line 11-11 thereof and depicting the rectangularly shaped trunk.
Figure 10:
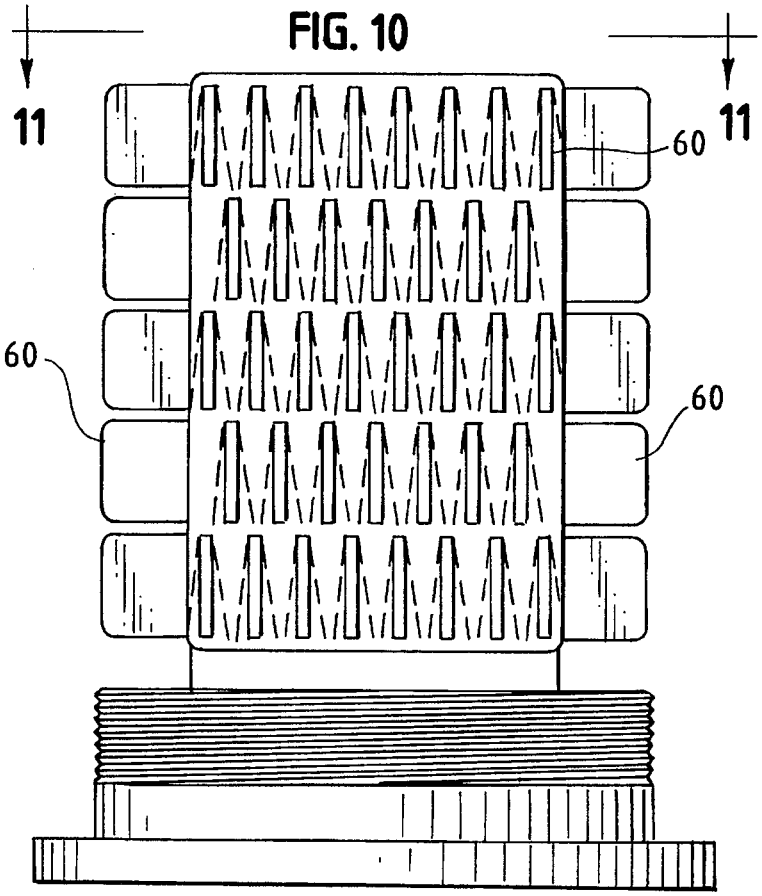
FIG. 10 is a elevational view, similar to FIG. 9, showing a structural variation thereof, wherein a rectangularly shaped trunk of the tree-like cold sink includes a plurality of branches or fingers extending outwardly from the four vertical sides of the trunk.

Based on the same theory of performance, FIGS. 9 and 10 show how boundary layer thickness can be reduced in the tree-like cold sink and also show that a tree-like cold sink may have a rectangular shape or any other configuration of finned shaped structure. FIG. 9 illustrates a pattern of heat flow lines within the tree-like cold sink. As shown, an increased heat transfer absorbed on the cold sink surface as a result of the inventive cold sink must pass through the area allocated for the cold head or the cold side of any other heat pump. Therefore, the contact area which is the bottom of the tree stem should be sufficiently large ranging from 2 square inches to 8 square inches or larger. By the same token, the trunk or stem cross-sectional area may be reduced toward the top of the cold sink, whereas the heat transfer requirement decreases toward the top of the tree. Similarly, the thickness of the cup wall of the cup-like cold sink may be reduced toward the top of the cup.

Figure 16:
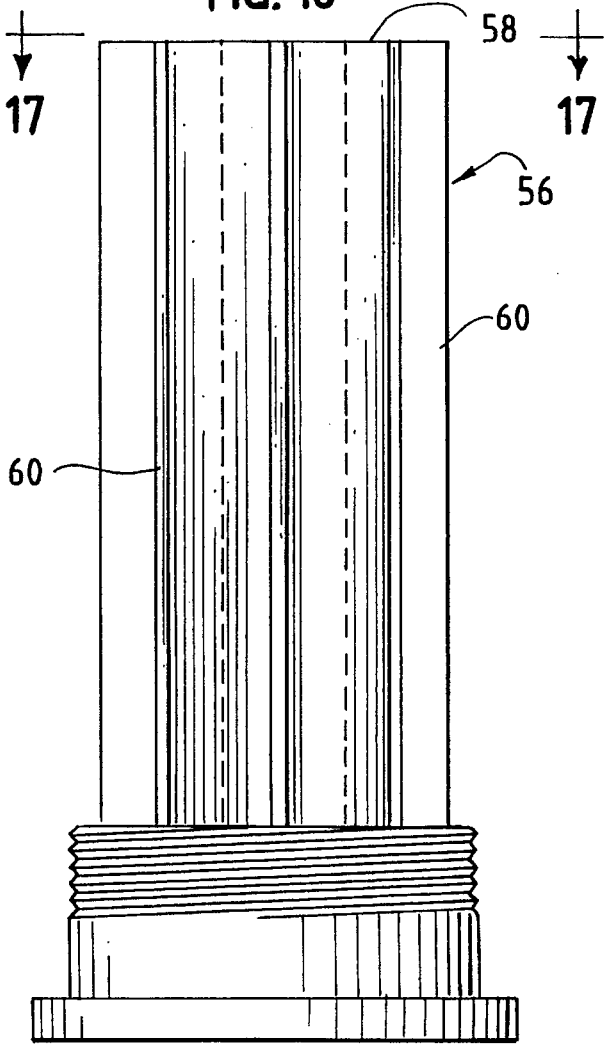
FIG. 16 is an elevational view, similar to FIG. 9, showing a structural variation thereof, wherein the plurality of tree-like branches or fingers are merged to form a plurality of continuous long fins.

As indicated above, even though the theory relating to performance of the tree-like cold sink provides a superior rate of transfer of energy, economic evaluations of manufacture may necessitate choosing a simple inventive configuration, such as a star-like configuration (Best seen in FIGS. 16 and 17), which is a special case where the tree branches have their base lengths bonded or otherwise suitably secured to the surface of the trunk, are arranged in vertical alignment form elongated fins or fingers branching out from the trunk or stem.

Although the structures of the cup-like and tree-like cold sinks look greatly different from each other, as illustrated in FIGS. 6, 7, 8, 9, 10 and 11, all of them have common features. Each cold sink member is submerged in liquid, has a large surface area, and has a heat transfer augmentation scheme on the surface. There is provided a thick central trunk or stem for the tree-like cold sink or a thick wall for the cup-like cold sink. Each member has a thick bottom base, is made from one piece so that there is no interface of solid surfaces, has a thick central portion at the bottom that may be optionally surrounded by an annular cavity, and each has a threaded portion near the bottom base to which the cold side of the heat pump thermoelectric module or the cold head of a free-piston Stirling heat pump cooling means may be joined by fastening means. The central, thick portion of the bottom base is equivalent to the spacer block in the conventional thermoelectric cooler. Since there is no interface between the spacer block and cold sink proper, the interface thermal resistance has been eliminated, which helps improve the cooling effect.

Figure 12:
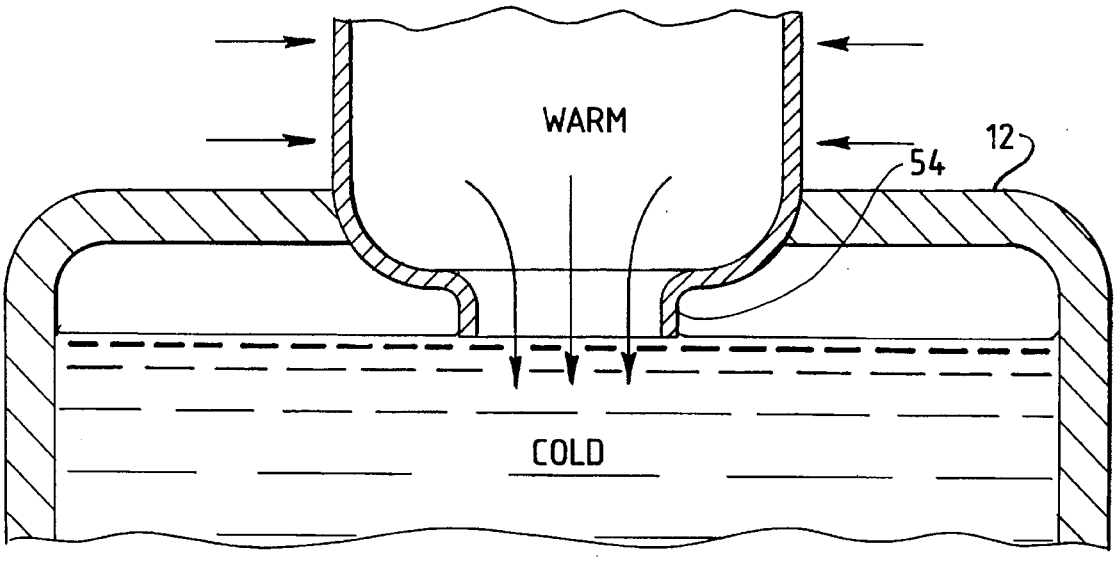
FIG. 12 is a cross sectional, elevational view showing the manner in which extraneous or ambient heat is transferred into and contributes to heating the previously chilled liquid contained in the reservoir of the apparatus.

It is now appropriate to discuss the theory relating to the inventive adapter 40 shown in the embodiments of FIGS. 1 and 3 as having a single outlet or diverter 42. FIG. 12 illustrates a condition of water level with respect to the bottle mouth 54 resting in the water tank 12 of a conventional water cooler. As shown, the bottled liquid that is warm and needs to be cooled, is connected through a large bottle mouth 54, approximately 1.5 in diameter, with the chilled liquid in the liquid tank. Therefore, there is an appreciable amount of heat transfer from warm liquid to the chilled liquid.

Figure 13:
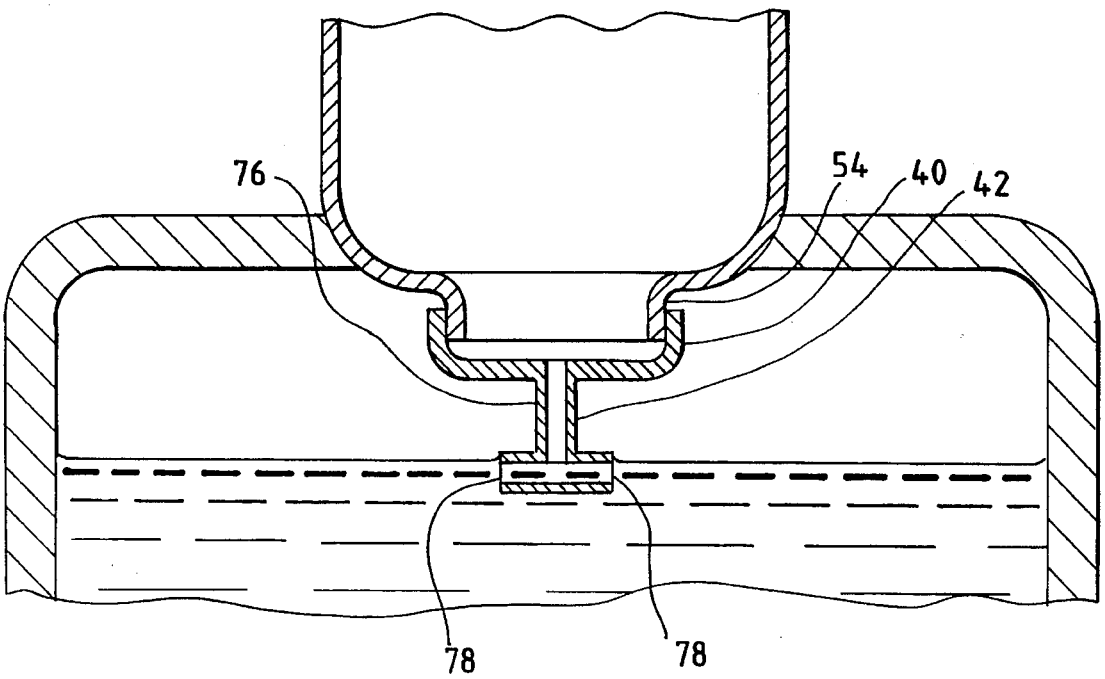
FIG. 13 is a cross sectional view, similar to FIG. 12, showing the manner in which extraneous or ambient heat flow into the reservoir can be minimized by using an adapter fitted around the opening of the bottle dispenser.
Figure 14:
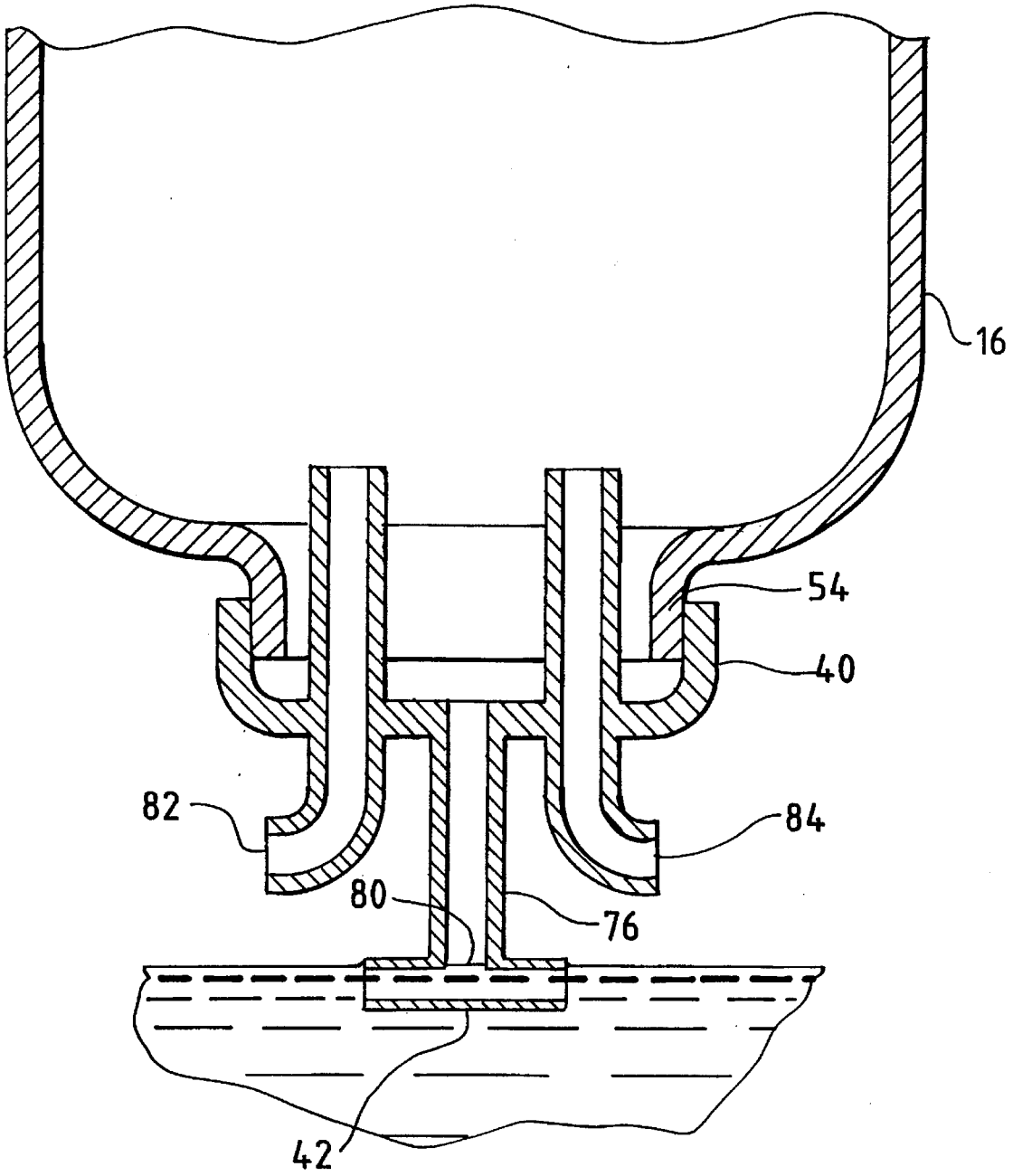
FIG. 14 is a cross sectional view, similar to FIGS. 12 and 14 showing the manner in which an adapter is modified to provide multiple nozzles for handling cold, hot and warm liquids.

The amount of heat transferred becomes an additional thermal load to the heat pump, which results in a longer time to cool the liquid to a desired temperature. To reduce the amount of transfer of heat flow to a minimum for faster cooling, the inventive adapter 40 which slips onto the bottle mouth is used. As best seen in FIG. 13, the adapter 40 has an extended outlet 76 with a liquid diverter outlet 78. The liquid diverter 78 is effective to cause the warm liquid to spread horizontally when new warm liquid is being supplied from the bottle as a result of chilled liquid being dispensed from the cooler rather than ejecting from the nozzle directly into the chilled liquid. This provision is necessary for increasing the total number of cups of liquid before the next cooling cycle is required. The size of the diverter 78 is small, approximately 0.25". Liquid level in the liquid tank is governed by hydraulic theory and is nearly the same level as the diverter tip, which suggests that the liquid level can be adjusted by the relative position of the diverter in the liquid tank. Comparing FIGS. 12 and 13, it is seen that the amount of heat transferring from the warm liquid in FIG. 13 should be substantially less than that in FIG. 12. This is because the connection of warm and cold liquids is made through a small liquid column in the adapter diverter so that heat transfer through the slender liquid column is nearly negligible. FIG. 14 illustrates an adapter 40 with three outlets, a diverter 80, and two other outlets, 82 and 84. The diverter 80 is operable for the dispensing of chilled liquid and has a longer length so that the tip of the diverter 80 first makes contact with the liquid surface when the liquid from the bottle flows into and fills the liquid tank. The other two outlets 82 and 84 are for connecting with the warm and hot liquid dispensing outlets, respectively. Since neither a warm liquid supply line or tubing, nor a hot liquid supply line or tubing is in contact with the chilled liquid in the tank, any extraneous heat loss that moves from the ambient liquid to the chilled liquid is negligible; hence, any extra heat load on the cooling system is eliminated, with a resultant advantage in economy of operation. This arrangement also prevents any chilled liquid from being diverted into a ambient and heated liquid outlet nozzles 83 and 85. Conventional systems are deficient in providing these indicated advantages.

Now referring specifically to FIG. 14, it will be understood that when a fresh bottle full of liquid is installed in the tank of the apparatus, the bottle 16 with adapter 40 affixed thereon, is placed on the tank 12 and the longer diverter 80 becomes positioned at substantially the equilibrium level of the liquid in the tank. In this example, in which the adapter 40 includes the diverter 80, and outlets 82 and 84, there is provided a first flexible tubing 86 (Refer to FIG. 15) of plastic or other suitable means to connect with the outlet 82 that is operable to supply unchilled liquid to a dispensing nozzle 83. Similarly, there is also provided a second flexible tubing 88 to connect with the outlet 84 that is operable to supply heated liquid to a dispensing nozzle 85. Each flexible tubing is connected to its respective outlet prior to installation of the bottle into the tank so that the only outlet exposed to ambient air is the diverter 80 that contacts the equilibrium level of the liquid in the tank. Because of the flexible nature of the adapter 40 and the relatively small diameter of the diverter 80, it is possible to be held closed by hand when inverting the bottle for installation on the tank.

Figure 15:
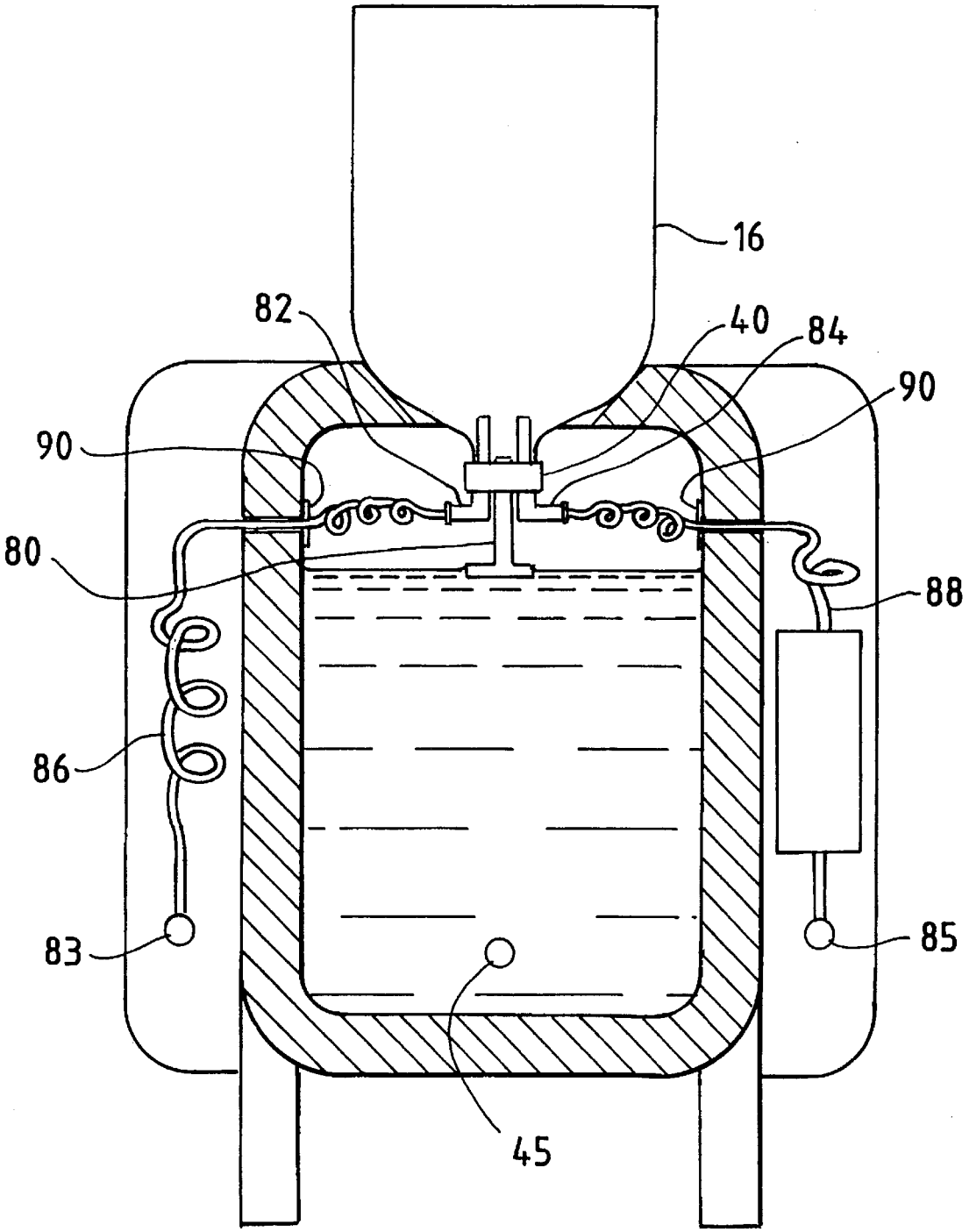
FIG. 15 is a cross sectional view of the apparatus of the present invention showing the manner of dispensing unchilled and heated liquids directly from a bottle reservoir without drawing any liquid from the tank of the apparatus.

As best seen in FIG. 15, each flexible tubing 86, 88 has installed therearound a stopper 90 for preventing the flexible tubing from being drawn through any opening formed through the liquid tank and also for having available a sufficiently long length of tubing to connect with its respective outlet of the adapter 40.

In the arrangement as shown, it will be understood that neither the unchilled liquid or the heated liquid will ever be in contact with the chilled liquid. This is in contradistinction to conventional liquid coolers wherein liquid is withdrawn near the liquid level of the tank for supplying the liquid heating element. Although the liquid near the upper liquid level is less cool than at the tank bottom, the temperature at that level is still nearly twenty degrees Celsius cooler than the ambient temperature and therefore requires unnecessary reheating of the liquid with a consequent wasting of valuable thermal energy. Similarly, any liquid destined for use as unchilled is not actually at an ambient temperature, but, in reality, is nearly twenty degrees Celsius cooler than room temperature.

Any heat pump or other thermoelectric cooling device inherently has important characteristics that the device becomes more effective in extracting heat when both the cold-side and hot-side temperatures increase simultaneously and that the cooling rate increases as the temperature difference between the two sides decreases. For these reasons, uniform spreading of liquid temperature in the liquid tank, with average liquid temperature being higher, is desirable, since the average higher liquid temperature also means the temperature difference across the thermoelectric module is smaller. Thus, the uniformity of liquid temperature is required not only for better quality of cooling but also for a higher cooling rate. The same theory applies to the case where ice is formed on the cold sink surface. When a liquid such as water reaches a temperature that is approximately 7 degrees Celsius, the cold sink surface may reach 0 degrees Celsius or lower, thus forming ice on its surface.

Since the inventive cold sink has a large surface area, the thickness of ice formed on its surface is thinner than that of conventional cold sink. Since ice is an insulator, heat transfer from the bulk liquid to the cold sink is more difficult with ice on the cold sink surface, suggesting that the desired cooling rate, or the ice forming rate, is smaller with the conventional cold sink, once ice begins to form. Therefore, embodiments equipped with the inventive cold sink will not only enhance the cooling rate before forming ice, but will also generate more ice once ice formation begins.

A further characteristic of the thermoelectric cooling device is that, in either heat extraction at the cold side or heat dissipation at the hot side, heat transfer occurs through a very restricted area; for example, only through the area of the thermoelectric module at both sides. In conventional systems, a metal block having a cross-sectional area equal to the that of the module, is necessary between the cold side of the module and the cold sink in order to provide for insulation. This insulation is needed to reduce any short circuiting of heat flow from the base plate of the heat sink to the cold sink. In all embodiments of the present invention, the metal block is an integral part of the cold member sink, thus eliminating any possible solid-to-solid interface.

In all embodiments of the present invention, the cold sinks are submerged in liquid, thus reducing the extraneous thermal load from the ambient air. Conventional liquid coolers usually use a metal liquid tank to which a cold head or cold sink side of the heat pump is attached and the liquid tank is insulated around it. In such a case, the temperature difference across the insulated wall is very large. On the other hand, in the present invention, the internal wall temperature is higher than with the conventional cooler because the bulk liquid is in contact with the internal surface of the wall, not the cold sink, and the bulk liquid is at a warmer temperature since it is maintained at a preselected distance from the cold sink member.

While the invention has been described with reference to a preferred embodiment, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the appended claims.

I claim:

1. An apparatus for dispensing cooled and heated liquids including a thermally insulated liquid tank, a bottle reservoir disposed upon the liquid tank for supplying liquid thereto, and a cold sink member affixed to the liquid tank and submerged in the liquid for controlling the temperature therein, said cold sink member comprising, upwardly extending, thick wall means formed from thermally conducting material, thermally conductive, thick bottom wall means integrally joined at a lower side of said thick wall means effective to form therebetween cup-like structure means, said thick wall means having formed therethrough at least two apertures for exchanging flow of liquid between the liquid surrounding an outer surface of said thick walls means and the space within said cup-like structure means, heat pump means disposed adjacent a bottom side of said bottom wall means for exchange of thermal energy therebetween, and heat sink member means positioned adjacent said heat pump means for absorbing and dissipating said thermal energy to ambient air.

2. An apparatus for dispensing cooled and heated liquid as claimed in claim 1 wherein said heat pump means operates on a Stirling cycle principle using an inert gas that does not change phase.

3. An apparatus for dispensing cooled and heated liquid as claimed in claim 1 wherein said heat pump means comprises, thermoelectric modules means.

4. An apparatus for dispensing cooled and heated liquids as claimed in claim 1 wherein said cold sink member means comprises, a plurality of fin means formed on a side surface of said thick wall means whereby the transfer of heat energy is greatly increased.

5. An apparatus for dispensing cooled and heated liquids as claimed in claim 1 wherein said cold sink member means comprises, a plurality of long length fin means formed on a side surface of said thick wall means whereby the transfer of heat energy is greatly increased.

6. An apparatus for dispensing cooled and heated liquids as claimed in claim 1 wherein said cold sink member means is submerged within the liquid of the tank in any desired orientation between vertical and horizontal.

7. An apparatus for dispensing cooled and heated liquids as claimed in claim 1 wherein said cold sink member means comprises, cavity means formed in said bottom wall means for minimizing heat transfer from surrounding ambient air.

8. An apparatus for dispensing cooled and heated liquids as claimed in claim 1 wherein said bottle reservoir comprises, adapter means for diverting the flow of liquid into said liquid tank and dispensing cooled liquid through at least one outlet nozzle at a preselected temperature.

9. An apparatus for dispensing cooled and heated liquids as claimed in claim 1 including liquid heater means wherein said bottle reservoir means comprises, diverter means for supplying liquid into said liquid tank and dispensing through nozzle means chilled liquid at a preselected temperature, and at least one additional outlet means for dispensing through separate nozzle means heated liquid at a preselected temperature.

10. An apparatus for dispensing cooled and heated liquids as claimed in claim 1 including liquid heater means wherein said bottle reservoir means comprises, adapter means for diverting the flow of liquid into said liquid tank, and three outlet means for respectively dispensing through separate nozzle means ambient, chilled and heated liquid at a respective preselected temperature.

11. An apparatus for dispensing cooled and heated liquids including a thermally insulated liquid tank, a bottle reservoir disposed upon the liquid tank for supplying liquid thereto, and a cold sink member affixed to the liquid tank and submerged in the liquid for controlling the temperature therein, said cold sink member comprising, upwardly extending, trunk member means formed from thermally conducting material, thermally conductive, thick bottom wall means integrally joined to a lower side surface of said trunk member means, cavity means formed in said bottom wall means for minimizing heat transfer from surrounding ambient air, a plurality of fin means formed integrally with said trunk member means extending outwardly therefrom to form therewith a tree-like structure for greatly increasing the transfer of heat energy, heat pump means disposed adjacent a bottom side of said bottom wall means for exchange of thermal energy therebetween, and heat sink member means positioned adjacent said heat pump means for absorbing and dissipating said thermal energy to ambient air.

12. An apparatus for dispensing cooled and heated liquid as claimed in claim 11 wherein said heat pump means operates on a Stirling cycle principle using an inert gas that does not change phase.

13. An apparatus for dispensing cooled and heated liquid as claimed in claim 11 wherein said heat pump means comprises, thermoelectric modules means.

14. An apparatus for dispensing cooled and heated liquid as claimed in claim 11 wherein said plurality of outwardly extending fin means are formed in a multi-fingered star-shaped configuration.

15. An apparatus for dispensing cooled and heated liquids as claimed in claim 11 wherein said bottle reservoir comprises, adapter means for diverting the flow of liquid into said liquid tank and dispensing cooled liquid through at least one outlet nozzle at a preselected temperature.

16. An apparatus for dispensing cooled and heated liquids as claimed in claim 11 including liquid heater means wherein said bottle reservoir means comprises, diverter means for supplying liquid into said liquid tank and dispensing through nozzle means chilled liquid at a preselected temperature, and at least one additional outlet means for dispensing through separate nozzle means heated liquid at a preselected temperature.

17. An apparatus for dispensing cooled and heated liquids as claimed in claim 11 including liquid heater means wherein said bottle reservoir means comprises, adapter means for diverting the flow of liquid into said liquid tank, and three outlet means for respectively dispensing through separate nozzle means ambient, chilled and heated liquid at a respective preselected temperature.

18. An apparatus for dispensing cooled and heated liquids as claimed in claim 11 wherein said cold sink member means is submerged within the liquid of the tank in any desired orientation between vertical and horizontal.

19. An apparatus for dispensing cooled and heated liquids including a thermally insulated liquid tank, a source of liquid for supplying liquid to the liquid tank, and a cold sink member affixed to the liquid tank and submerged in the liquid for controlling the temperature therein, said cold sink member comprising, upwardly extending, thick wall means constructed from thermally conducting material, thermally conductive, thick bottom wall means integrally joined at a lower side of said thick wall means effective to form therebetween cup-like structure means, said thick wall means has formed therethrough at least two apertures for natural convection flow of liquid between the liquid surrounding an outer surface of said thick walls means and the space within said cup means, heat pump means disposed adjacent a bottom side of said bottom wall means for exchange of thermal energy therebetween, and heat sink member means positioned adjacent said heat pump means for absorbing and dissipating said thermal energy to ambient air.

20. An apparatus for dispensing cooled and heated liquid as claimed in claim 19 wherein said heat pump means operates on a Stirling cycle principle using an inert gas that does not change phase.

21. An apparatus for dispensing cooled and heated liquid as claimed in claim 19 wherein said heat pump means comprises, thermoelectric modules means.

22. An apparatus for dispensing cooled and heated liquids including a thermally insulated liquid tank, a source of liquid for supplying liquid to the liquid tank, and a cold sink member affixed to the liquid tank and submerged in the liquid for controlling the temperature therein, said cold sink member comprising, upwardly extending, trunk member means formed from thermally conducting material, thermally conductive, thick bottom wall means integrally joined to a lower side surface of said trunk member means, cavity means formed in said bottom wall means for minimizing heat transfer from surrounding air, a plurality of fin means formed integrally with said trunk member means extending outwardly therefrom to form therewith a tree-like structure for greatly increasing the transfer of heat energy, heat pump means disposed adjacent a bottom side of said bottom wall means for exchange of thermal energy therebetween, and heat sink member means positioned adjacent said heat pump means for absorbing and dissipating said thermal energy to ambient air.

23. An apparatus for dispensing cooled and heated liquid as claimed in claim 22 wherein said heat pump means operates on a Stirling cycle principle using an inert gas that does not change phase.

24. An apparatus for dispensing cooled and heated liquid as claimed in claim 22 wherein said heat pump means comprises, thermoelectric modules means.

* * * * *